United States Patent [19]

Grabbe et al.

[11] Patent Number: 4,486,061

[45] Date of Patent: Dec. 4, 1984

[54] ZERO INSERTION FORCE CONNECTOR HAVING IMPROVED SUBSTRATE CLAMP

[76] Inventors: Dimitry G. Grabbe, 301 Main St., Lisborn, Me. 04252; Iosif Korsunsky, 3600 Brookridge Ter., #203, Harrisburg, Pa. 17109

[21] Appl. No.: 337,569

[22] Filed: Jan. 7, 1982

[51] Int. Cl.[3] ..... H01R 23/70

[52] U.S. Cl. ..... 339/75 MP; 339/176 MP

[58] Field of Search ..... 339/75 MP, 176 MP

[56] References Cited

U.S. PATENT DOCUMENTS

| | | | |
|---|---|---|---|
| 3,107,961 | 10/1963 | Hahn et al. | 339/17 |
| 3,259,807 | 7/1966 | Drugan et al. | 339/75 MP |
| 3,569,904 | 3/1971 | Hill et al. | 339/75 |
| 4,087,148 | 5/1978 | Bauerle | 339/75 MP |
| 4,152,037 | 5/1979 | Bonhomme | 339/75 MP |
| 4,176,900 | 12/1979 | Hines et al. | 339/75 MP |
| 4,211,458 | 7/1980 | Kent | 339/75 MP |
| 4,261,631 | 4/1981 | Guilcher et al. | 339/75 MP |

FOREIGN PATENT DOCUMENTS

| | | | |
|---|---|---|---|
| 2408274 | 6/1979 | France | 339/75 M |
| 1480183 | 7/1977 | United Kingdom | 339/176 MP |

OTHER PUBLICATIONS

Western Electric Technical Digest No. 64, Oct. 1981, "Zero Insertion Force Connector", Seaman, G. G.

*Primary Examiner*—John McQuade

[57] ABSTRACT

Zero insertion force connector for a substrate comprises housing having a surface against which the substrate is positioned. Terminals in the housing engage conductors on the substrate. A clamping bar is located beside the housing and is movable between first and second positions, the bar being relatively remote from the surface when in the second position and proximate to the surface when in the first position so that it clamps the substrate against the surface. The clamping bar is moved between its first and second positions by a force multiplying actuator.

10 Claims, 10 Drawing Figures

ZERO INSERTION FORCE CONNECTOR HAVING IMPROVED SUBSTRATE CLAMP

FIELD OF THE INVENTION

This invention relates to multi-contact electrical connectors for substrates having terminal pads on one side thereof. A connector in accordance with the invention is of the general type described in U.S. Pat. No. 4,370,012.

BACKGROUND OF THE INVENTION

U.S. patent application Ser. No. 06/208,734 now U.S. Pat. No. 4,370,012 describes and claims a multi-contact connector for single sided substrates (having terminal pads on only one side which are contacted by the connector terminals) of the zero insertion force type. Connectors in accordance with the above identified U.S. application can be constructed with the terminals on closely spaced centers and are capable of accommodating a relatively large number of terminals. A connector in accordance with the above identified application has an insulating housing which contains the terminals in side-by-side relationship with the contact portions of the terminals extending beyond one surface of the terminal housing. The substrate is clamped against the surface of the housing by a clamping means so that the terminal pads on the substrate electrically contact the contact portions of the terminals. The clamping means for clamping the substrate against the housing comprises a cam which extends beside the housing and which, upon rotation, urges the substrate against the housing.

A connector in accordance with the above identified application has a formed metallic frame and a separate formed spring on the frame which cooperate with the cam shaft to provide the clamping means for the substrate. It would be desirable to provide a clamping means of simplified construction, as compared with the clamp shown in U.S. Pat. No. 4,370,012, in order to improve the reliability and decrease the cost of the connector. It would further be desirable to provide a force multiplier for the clamp which would permit placement of substrates in connectors and removal of the substrates without the aid of an additional tool. It is also important that connectors of the type shown in the above identified application be capable of being placed on a circuit board in closely stacked relationship and that the substrates be individually removable from the connectors in the stock. The present invention is, in general, directed to the achievement of these improvements to connectors of the type shown in the above identified U.S. Pat. No. 4,370,012.

A zero insertion force electrical connector in accordance with the invention is of the type comprising a terminal housing having a plurality of terminals in the housing, the terminals having contact portions which normally extend beyond a first surface of the terminal housing. The connector has a clamp for clamping a substrate or the like against the first surface of the housing so that terminal pads on the substrate will electrically contact the contact portions of the terminal. A connector in accordance with the invention is particularly characterized in that the clamp comprises a clamping bar which extends parallel to, and is spaced from, the one surface of the terminal housing, the clamping bar being movable parallel to its axis between first and second positions. A guide is provided which is effective between the clamping bar and the terminal housing and which moves the clamping bar laterally of its axis towards the first surface of the terminal housing when the clamping bar is moved from the second position to the first position and which moves the clamping bar away from the first surface when the clamping bar is moved from the first position to the second position so that upon placement of edge portions of the substrate between the clamping bar and the first surface of the terminal housing when the clamping bar is in the second position and upon thereafter moving the clamping bar to the first position, the substrate will be clamped against the first surface of the housing and the terminal pads on the substrate will be pressed in against the contact portions of the terminals.

In accordance with a further embodiment, a force multiplying actuator is provided for moving the clamping bar between the first and second positions. In accordance with a further embodiment, the terminal housing is supported in a frame which has guide portions which extend beside the first surface of the terminal housing at the ends of the housing. The guide comprises pin-slot connections between the clamping bar and the guide portions portions of the frame. In accordance with a still further embodiment, the guide is resiliently deformable to permit variation of the position of the clamping bar when the clamping bar is in the first position whereby the connector can be used with substrates of varying thickness. In accordance with further embodiments, the force multiplying actuator comprises a rotary cam mounted adjacent to one end of the terminal housing, the clamping bar having an extension which surrounds the cam so that upon rotation of the cam, the clamping bar is moved between the first and second positions. In accordance with further embodiments, the cam comprises a cylindrical body having an eccentric pin extending therefrom which is received in a slot in the surface on an adjacent section of the housing so that rotation of the cylindrical body causes lateral movement thereof and movement of the clamping bar. In accordance with a still further embodiment, the force multiplying actuator has a handle extending therefrom by means of which it is operated, the handle being inclined in a manner such that it will nest with handles extending from the forced multipliers of adjacent connectors.

PREFERRED EMBODIMENT

Figure 1:
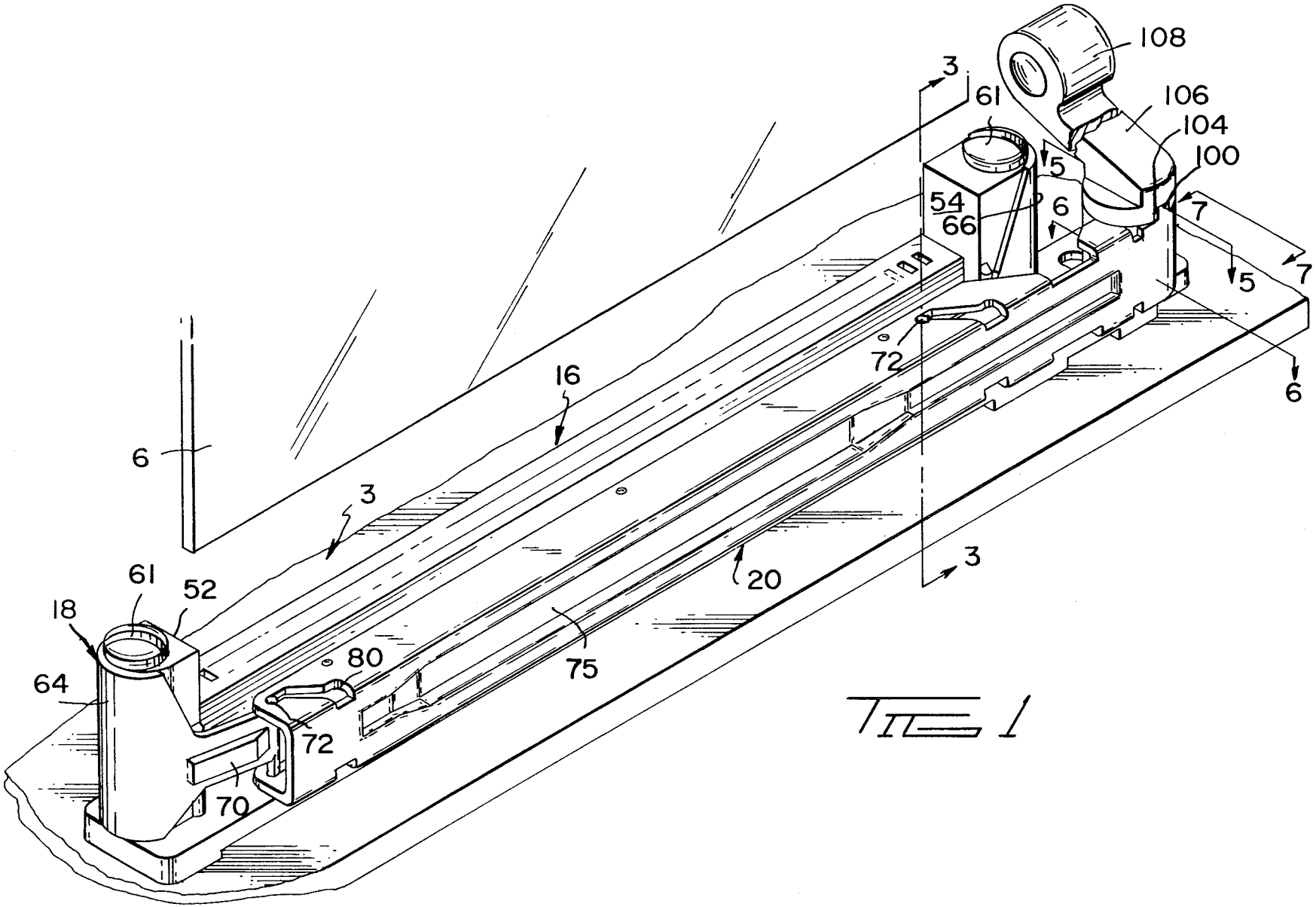
FIG. 1 is a perspective view of a connector in accordance with the invention, the connector being shown in its open position with a substrate shown in alignment with a connector.
Figure 3:
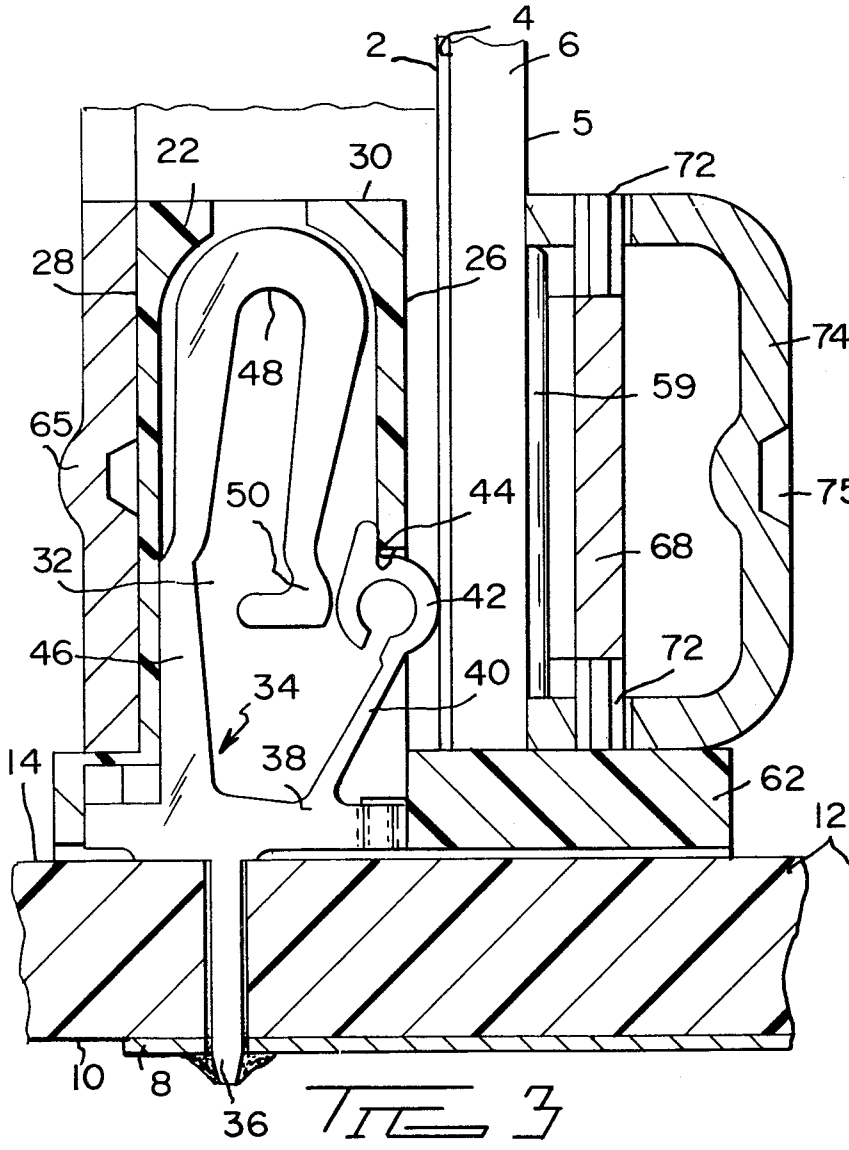
FIG. 3 is a view taken along the lines 3—3 of FIG. 1.

A connector 3 in accordance with the invention, as shown in FIGS. 1 and 3, functions to connect conductor 2 on one side 4 of a substrate 6 to conductors 8 on the lower surface 10 of a circuit board 12. The circuit board has an upper surface 14 on which the connector is retained by screws 61. The connector is made up of an insulating terminal housing 16, a frame 18 of steel or similar resilient metal and a clamping bar 20 which is also of steel or other strong metal.

The housing 16 is molded as a one piece part of a suitable insulating material and has a central rectangular body 22 which is integral with a base or support 62. The central body 22 has one major side surface 26 against which the side 4 of the substrate is clamped and a second major side surface 28 which is oppositely directed relative to the surface 26. The housing also has a top surface 30 as viewed in the drawing and a plurality of side-by-side cavities 32 in the central body 22.

Each cavity 32 contains a terminal 34 having a post 36 which extends through circuit board 12 and is soldered to the conductor 8. The terminal has a yoke portion 38 which is adjacent to surface 14 and has a contact arm 40 extending obliquely from the yoke portion past the surface 26. The contact portion 42 of the contact arm normally extends through an opening 44 in the side 26 and the contact arm can be flexed leftwardly from the position of FIG. 3 to the position of FIG. 2 when a substrate 6 is clamped against surface 26. A spring arm 46 also extends towards the top surface 30. The spring arm is curved as shown at 48 and has a free end 50 which is adjacent to the contact portion 42. The spring arm provides support for the contact arm when the contact arm is flexed, whereby a controllable contact force is established at the electrical interface between the contact portion of the terminal pads on the substrate. Terminals of the type shown at 34 are described in detail in U.S. Pat. No. 4,370,012.

Figure 2:
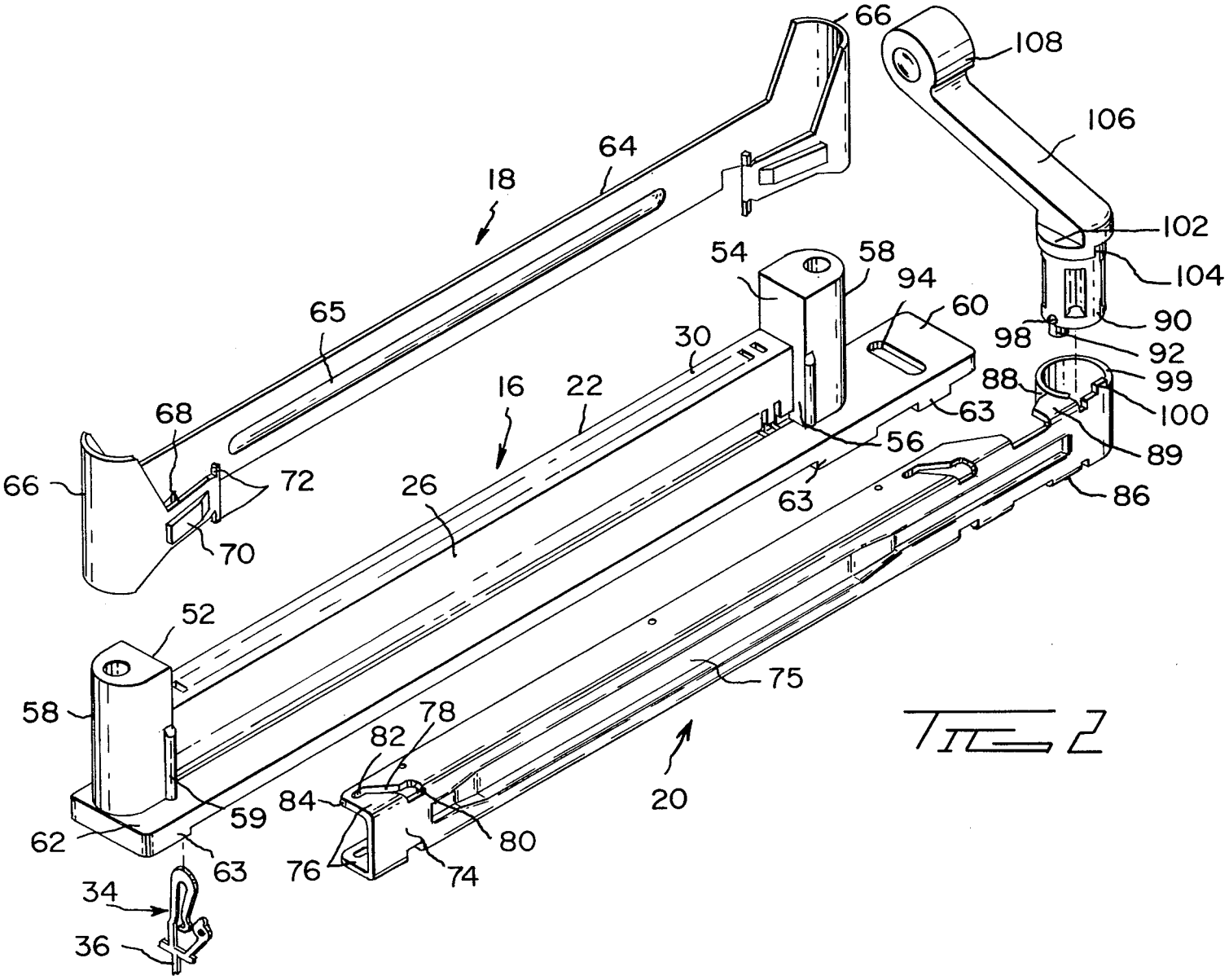
FIG. 2 is a perspective exploded view of the parts of the connector.
Figure 4:
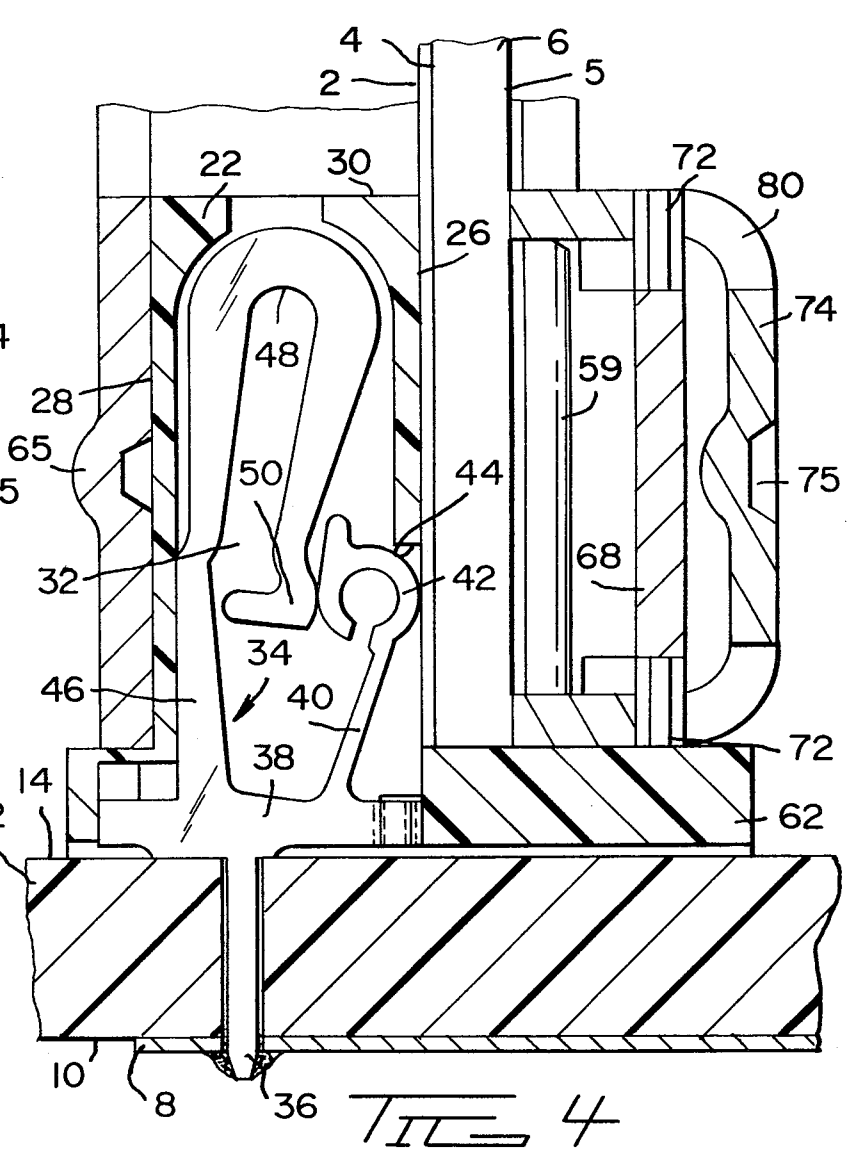
FIG. 4 is a view similar to FIG. 3 but showing the clamping bar in its first or closed position and in clamping engagement with a substrate.

The housing 16 has integral columns 52, 54 at its ends which extend upwardly as viewed in FIG. 2, beyond the upper surface 30 of the central portion 22 of the housing. These columns have surfaces 56 which extend beyond the plane of the one surface 26 of the central portion 22 thereby precisely to position the substrate 6 against the surface 26 with the terminal pads on the substrate in alignment with the contact portions 42 of the terminals 34. The previously identified screws 61 extend through these columns and are threaded through the columns and into the circuit board. The oppositely and outwardly facing surface of the columns 52, 54 are as shown at 58, and conform to cylindrically formed portions of the frame 18. As described below also, integral vertically extending bars 59 are provided on the columns adjacent to the surfaces 56. The integral bars 59 determine the preload of spring members 68 which are part of the frame.

The central portion 22 and the columns 52, 54 of the housing are integral with the housing base or support 62 which extends beyond the column 54 as shown at 60. The support or base 62 has relatively thickened sections as shown at 63, which rest on the upper surface 14 of the circuit board so that the underside of the central portion of the support 62 is spaced from the surface 14 as shown in FIG. 3. This arrangement is desirable to permit cleaning following soldering of the post portions 36 of the terminals to the conductors 8.

The frame 18 is formed of stamped and formed spring steel on similar material and comprises an elongated strap portion 64 that extends across the side 28 of the housing. The strap portion may be embossed as shown at 65 for strengthening and stiffening purposes. The ends of the strap portion 64 have integral semicylindrical formed portions which are dimensioned to surround the cylindrical surfaces 58 of the columns 52, 54. Resilient clamping portions 68 extend from the cylindrical portions 66 and are also embossed for strengthening purposes, as shown at 70. These clamping portions serve as springs and urge the clamping bar 20 relatively towards the surface 26. The clamping portions 68 have integral vertically extending pins 72 on their ends which are received in slots 78 in the clamping bar as described below.

The clamping bar 20 is generally channel-shaped and has a web 74 and sidewalls 76. The web may be strengthened with a rib or embossment, as shown at 75. Slots 78 are provided in the sidewalls 76 which receive the pins 72 on the ends of the extensions 68. The intermediate portions of the slots extend obliquely in the sidewalls 76 and the slots have ends 82 which are adjacent to the edges 84 of the sidewalls. The other ends of the slots 80 are enlarged, as shown in FIG. 2 and are located adjacent to the edge formed by the sidewalls 76 and the web 74.

The web extends rightwardly in FIG. 2 beyond the ends of the sidewalls as shown at 86, and a hollow cylinder 88 is formed on the ends of this extension. Stop ears 89 are formed from the side edges of the extension to support the cylindrically formed end portion 88 as was shown in FIG. 2.

The cylindrical end of the clamping bar receives a camming drum 90 having an integral pin 92 extending eccentrically from its lower surface. This pin is received in a straight slot 94 in the extension 60 of the base 62 of the housing so that rotation of the drum 90 will cause the drum to move parallel to the length of the support 62 and transversely of the support.

Figures 5, 6, 7, 10:
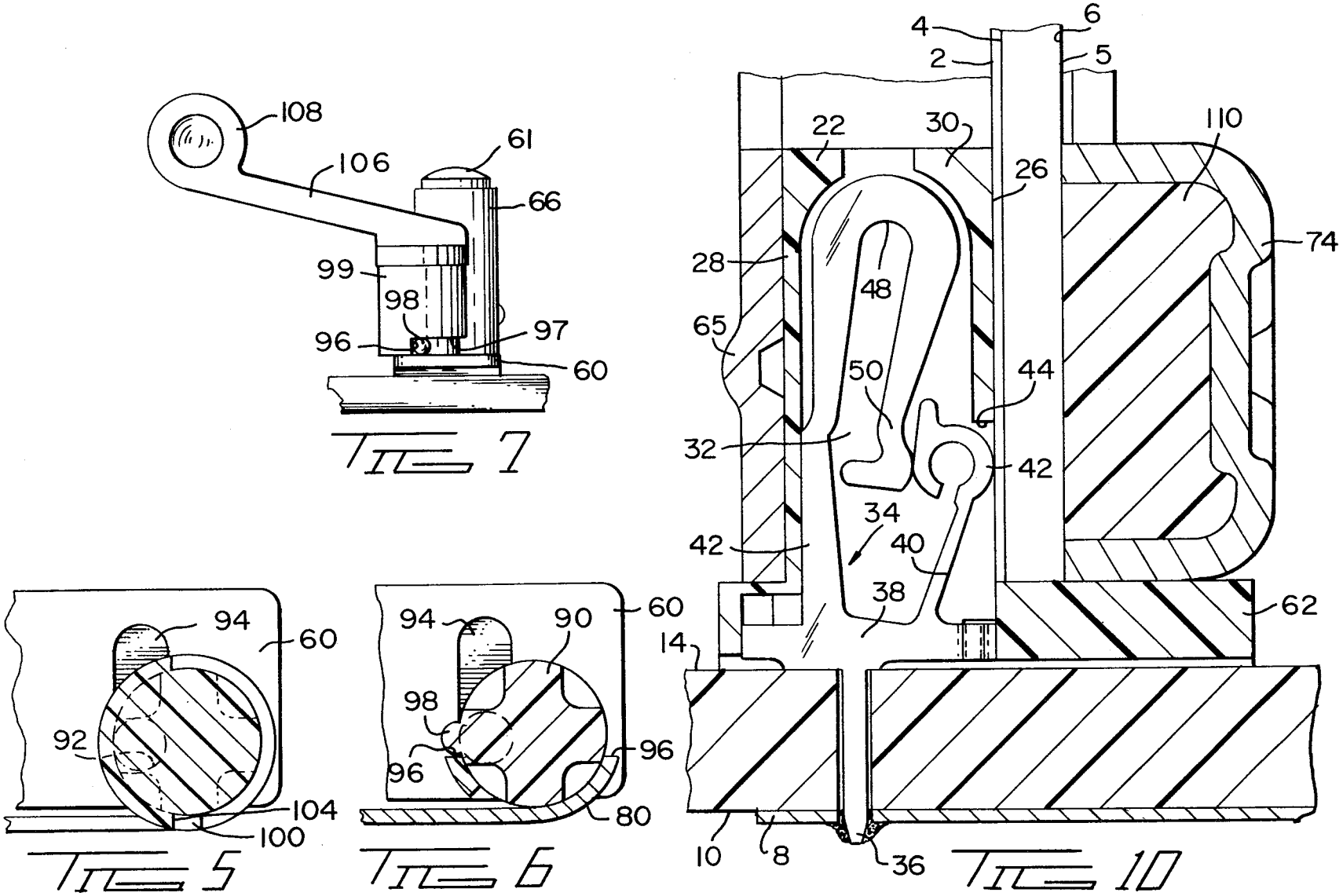
FIGS. 5, 6, and 7 are views taken along the lines 5—5, 6—6, and 7—7 respectively, of FIG. 1 (the handle 106 being rotated 180° in FIG. 7 from the position shown in FIG. 1).
FIG. 10 is a view similar to FIG. 3 and illustrating the use of a plastic insert in the clamping bar.

As shown in FIG. 6, the cylindrical end 88 is relieved or cut away on its lower edge, as shown at 96, to provide clearance for retaining boss 98 on the surface of the drum. This retaining boss bears against the horizontal shoulder 97 shown in FIG. 7 and thereby retains the camming drum in the cylindrical end portion 88 of the clamping bar. The upper edge 99 of the cylindrical portion 88 of the clamping bar has upwardly extending stop 100 and the upper end of the camming drum is provided with a crown portion 102 which extends radially beyond the surface of the lower portion of the drum 90. This crown portion is provided with a recess that forms stops 104. These stops permit rotation of the drum through an angle of 180° in a counter-clockwise direction from the position shown in FIG. 1.

An integral handle 106 extends radially and upwardly from the crown portion 102 and has an enlarged end 108 so that it can be grasped with the fingers when the drum is to be rotated.

In the assembled connector, the edges 84 of the sidewalls of the clamping bar 20 will be relatively remote from the surface 26 when the handle 106 is in the position of FIG. 1 and the substrate can be moved downwardly to position the side 4 of the substrate adjacent to the surface 26. Upon rotation of the handle, the camming bar is moved linearly (parallel to its axis) and leftwardly laterally of its axis, as viewed in FIG. 1, and the pins 72 move relatively through the intermediate portions 78 of the slots to the enlarged ends 80. The clamping bar in effect moves diagonally between its two positions and the diagonal movement has one component which is parallel to the axis of the clamping bar and another component which is at right angles to the clamping bar. During such movement, the clamping bar is moved relatively towards the side 5 of the substrate and clamps the substrate against the surface 26. During such movement, the portions 68 of the frame will flex if the substrate is firmly against the surface 26 before the pins have arrived in the enlarged ends 80 of the slots.

Figure 8:
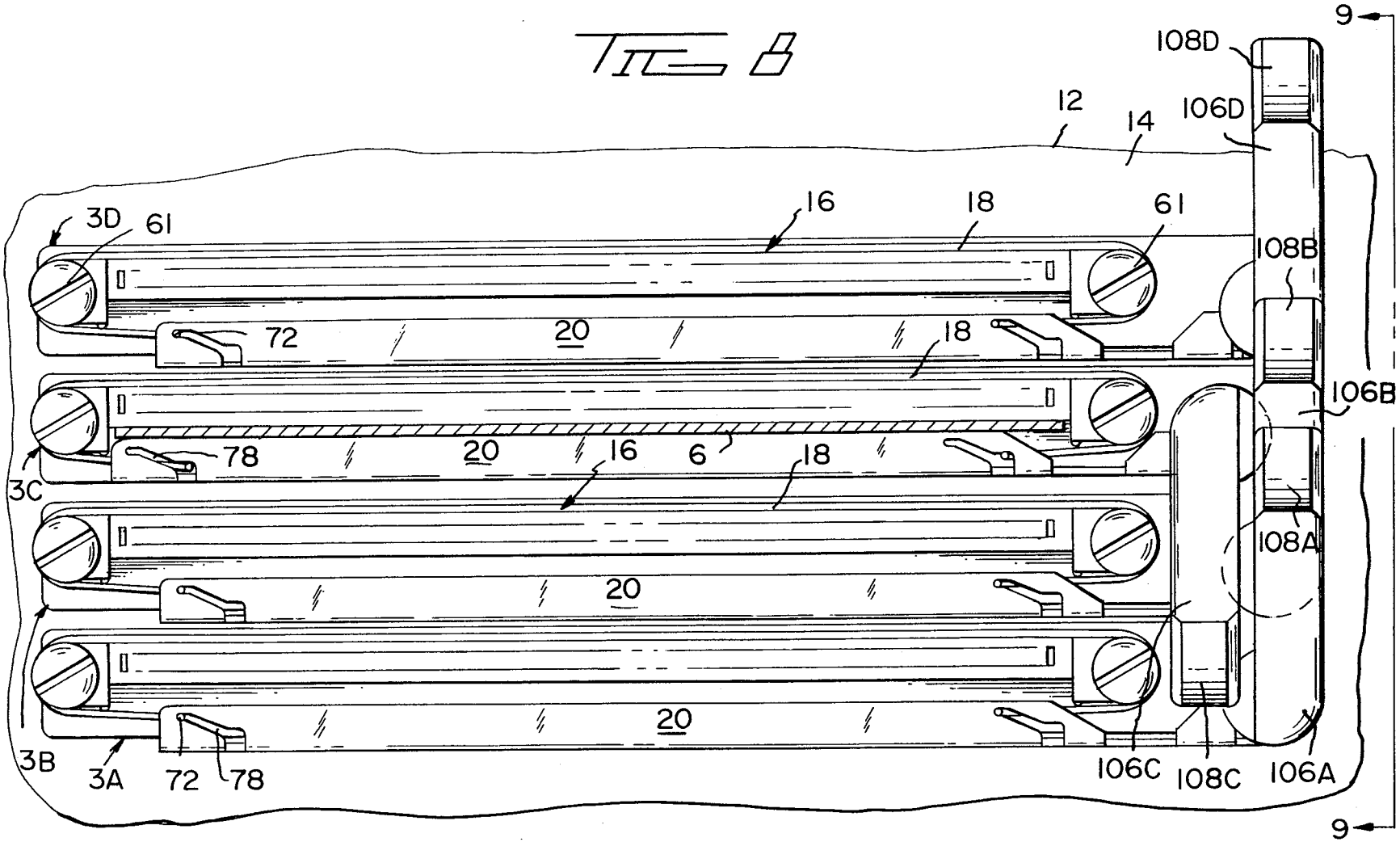
FIG. 8 is a plan view of a plurality of connectors stacked against each other on a circuit board.
Figure 9:
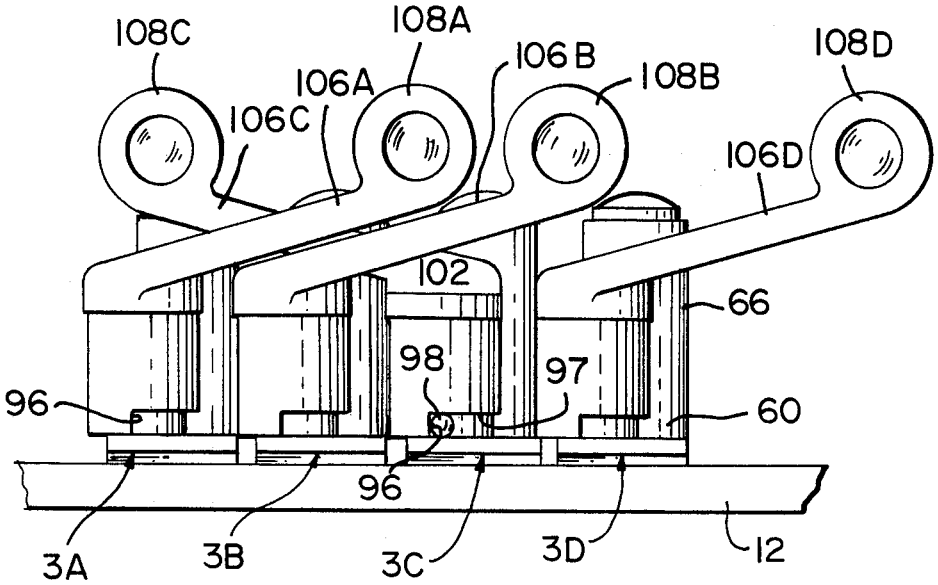
FIG. 9 is a view looking in the direction of the arrows 9—9 of FIG. 8.

FIG. 8 is a plan view showing four connectors on surface 14 on circuit board 12 stacked against each other in parallel relationship, the connectors being identified by the reference figures 3A, 3B, 3C and 3D. The connector 3C, is in its closed position with a substrate 6 clamped against the connector housing while the remaining connectors, 3A, 3B and 3D, are open. The handle 106 of the connector 3C accordingly extends downwardly as viewed in FIG. 8, while the handles of the remaining connectors extend upwardly. It will be apparent from FIGS. 8 and 9 that the remaining connectors 3A, 3B, and 3D can be closed by simply rotating the handles of these connectors through clockwise arcs of 180°.

When all of the connectors in a stack, such as the stack shown in FIG. 8, are in a closed condition, any one of the connectors can be opened by rotating its handle through a counter-clockwise arc of 180°. If an adjacent connector is to be opened, the handle of the previously opened connector is rotated through an angle of 90° so that the handle would extend rightwardly as viewed in FIG. 8. The adjacent connector can then be opened by rotating its handle through a counter-clockwise arc of 180°.

FIG. 10 shows a modified embodiment in which a plastic insert 110 is provided in the clamping bar between the sidewalls 76. This insert will protect any components which may be mounted on the surface 5 of the substrate 6.

A significant advantage of a connector in accordance with the invention is, as explained above, that the extensions 68 on the frame are capable of flexure in the event that the substrate is of a thickness such that the clamping bar cannot be moved to its fully closed position. The extension 68 under such circumstances will flex and permit movement of the clamping bar to its fully closed position. It will also be apparent that the connector of the present invention is of simplified construction. The frame member 18 is a relatively simple stamping and the body portions 22 and the base 62 of the housing can be provided as a one piece molding. The clamping bar itself is a simple shape which is easily formed as shown from a standard channel. Finally, and as explained above, substrates in a connector in the middle of a stack of substrates can be individually removed by merely rotating the handle of the connector which is holding the substrate.

Connectors in accordance with the invention can be provided with terminals which are adapted to be soldered directly to conductors on the upper surface 14 of the circuit board 12 rather than terminals as shown at 34 having posts for soldering to the lower surface 10.

An added advantage of connectors as described above is that the terminal housing 16 is entirely surrounded by metallic shielding formed by the frame 18 and the clamping bar 20. The housing can be dimensioned, particularly as regards the thickness of the housing walls, to produce a particular characteristic impedance as required by the equipment on which the connector is used.

What is claimed is:

1. A zero insertion force electrical connector of the type comprising a terminal housing having a plurality of terminals in the housing, the terminals having contact portions which normally extend beyond a first surface of the terminal housing, and a clamp for clamping a substrate or the like against the first surface of the housing so that terminal pads on the substrate electrically contact the contact portions of the terminals, the connector being characterized in that:

the clamp comprises a clamping bar which extends parallel to, and is spaced from, the one surface of the terminal housing, the clamping bar being movable parallel to its axis between first and second positions, a guide is provided which is effective between the clamping bar and the terminal housing and which moves the clamping bar laterally of its axis towards the first surface of the terminal housing when the clamping bar is moved from the second position to the first position and which moves the clamping bar away from the first surface of the terminal housing when the clamping bar is moved from the first position to the second position, the guide being resiliently deformable to permit variation of the position of the clamping bar when the clamping bar is in the first position with a substrate clamped against the first surface of the terminal housing whereby the connector can be used with substrates of varying thickness whereby, upon placement of edge portions of the substrate between the clamping bar and the first surface of the terminal housing when the clamping bar is in the second position and then moving the clamping bar to the first position, the substrate will be clamped against the first surface of the housing and the terminal pads on the substrate will be pressed against the contact portions of the terminals.

2. A zero insertion force connector as set forth in claim 1 characterized in that the terminal housing is supported in a frame, the frame having guide portions which extend beside the first surface of the terminal housing at the ends of the terminal housing, the guide comprising pin-slot connections between the clamping bar and the guide portions of the frame.

3. A zero insertion force electrical connector of the type comprising a terminal housing having a first surface against which a substrate can be positioned, contact terminals in the housing, the terminals having contact portions which normally extend beyond the first surface, the housing being supported in a housing frame which partially surrounds the housing, and a clamp for clamping a substrate against the first surface, the connector being characterized in that:

the clamp comprises a clamping bar which extends beside, and is spaced form, the first surface of the housing, the clamping bar being movable relatively towards and away from the first surface between first and second positions, the clamping bar being closest to the first surface when it is in its first position, a guide is provided for guiding the clamping bar during movement between its first and second positions, the guide comprising interengaging portions on the clamping bar and the frame, the guide being resiliently deformable to permit variation of the position of the clamping bar when the clamping bar is in the first position with a substrate clamped against the first surface of the terminal housing whereby the connector can be used with substrates of varying thickness, and a force multiplying actuator is provided for moving the clamping bar between its first and second positions whereby, upon placement of a substrate between the clamping bar and the first surface when the clamping bar is in the second position and then moving the clamping bar to the first position, the substrate is clamped against the first surface by the clamping bar and terminal pads on the substrate will be pressed against the contact portions of the terminals.

4. A zero insertion force electrical connector as set forth in claim 3 characterized in that the guide comprises pin-slot couplings on the clamping bar and the frame.

5. A zero insertion force electrical connector as set forth in claim 4 characterized in that the pin-slot couplings comprise pins on the frame and slots in the guide bar which receive the pins.

6. A zero insertion force electrical connector as set forth in claim 4 characterized in that the slots of the pin-slot couplings extend obliquely with respect to the first surface so that the clamping bar is moved parallel to the first surface while it is being moved between the first and second positions.

7. A zero insertion force connector as set forth in claim 6 characterized in that the frame has guide portions which extend beside the first surface of the terminal housing at the ends of the terminal housing, the interengaging portions of the guide which are on the frame being on the guide portions, the guide portions being resiliently deformable thereby to provide the resilient deformability in the guide.

8. A zero insertion force electrical connector as set forth in claim 6 characterized in that the force multiplying actuator comprises a rotary cam mounted adjacent to one end of the terminal housing, the clamping bar having an extension which surrounds the cam so that upon rotation of the cam, the clamping bar is moved between the first and second positions.

9. A zero insertion force electrical connector as set forth in claim 8 characterized in that the rotary cam comprises a cylindrical body having its axis extending normally of the supporting surface on which the connector is mounted, the one surface of the housing extending normally of the supporting surface, the supporting surface having a camming slot therein beneath the cylindrical body which receives a pin extending from the cylindrical body whereby the cylindrical body moves away from the one end of the housing when the cylindrical body is rotated in a direction which causes the clamping bar to move from the first position to the second position.

10. A zero insertion force electrical connector as set forth in claim 9 characterized in that the cylindrical body has a lever arm extending radially therefrom for rotating the cylindrical body, the lever arm being inclined away from the cylindrical body and being dimensioned to nest with an identical lever arm extending from the cylindrical body of an identical connector located beside the connector.

* * * * *